United States Patent [19]

Miyawaki et al.

[11] Patent Number: 4,906,833

[45] Date of Patent: Mar. 6, 1990

[54] ELECTRON BEAM INFORMATION EXCHANGE APPARATUS WITH CONVERTING LIGHT SIGNALS

[75] Inventors: Mamoru Miyawaki, Tokyo; Yukio Masuda, Atsugi; Ryuichi Arai; Nobutoshi Mizusawa, both of Sagamihara; Takahiko Ishiwatari, Yamato; Masahiko Okunuki, Tokyo, all of Japan

[73] Assignee: Canon Kabushiki Kaisha, Tokyo, Japan

[21] Appl. No.: 240,467

[22] Filed: Sep. 6, 1988

Related U.S. Application Data

[63] Continuation of Ser. No. 111,597, Oct. 23, 1987, abandoned.

[30] Foreign Application Priority Data

Oct. 27, 1986 [JP] Japan ..... 61-253572
Oct. 27, 1986 [JP] Japan ..... 61-253573
Oct. 27, 1986 [JP] Japan ..... 61-253574

[51] Int. Cl.[4] ..... H01J 31/50; H01J 40/14

[52] U.S. Cl. ..... 250/213 A; 250/214 SW; 357/40; 455/600; 350/96.1

[58] Field of Search ..... 315/8.51, 11, 5.14; 313/231.31; 357/40; 350/96.11, 96.1, 96.14, 96.13; 307/311, 407; 455/602, 600; 250/551, 214 SW, 213 A

[56] References Cited

U.S. PATENT DOCUMENTS 3,229,280 1/1966 Chapin ..... 315/8.51
3,483,515 12/1969 Oliver ..... 340/165
3,736,459 5/1973 Harris ..... 315/11
3,745,404 7/1973 Crost ..... 315/11
3,774,168 11/1973 Koo et al. ..... 315/8.51
3,775,636 11/1973 McNally ..... 315/11
3,914,600 10/1975 Redman ..... 315/11
3,969,699 7/1976 McGlaughlin ..... 315/11
4,365,863 12/1982 Broussaud ..... 350/96.15
4,647,909 3/1987 Spalding ..... 315/8.51
4,679,893 7/1987 Ramer ..... 350/96.14

FOREIGN PATENT DOCUMENTS 2170919 8/1986 United Kingdom .

OTHER PUBLICATIONS

Extracted translation of FR-A1-2,523,393 (p.3, 1.20-p.9,1.18).

Schmidt et al., "Experimental 4×4 Optical Switching Network", *Electronics Letters*, vol. 12, No. 22, pp. 575-577, 10/76.

*Primary Examiner*—David C. Nelms
*Assistant Examiner*—Michael Messinger
*Attorney, Agent, or Firm*—Fitzpatrick, Cella, Harper & Scinto

[57] ABSTRACT

An electron-beam information exchange apparatus adapted to effect information exchange in incoming light signals and outgoing light signals by utilizing electron beams. The apparatus has a plurality of electron beam generating means for generating electron beams according to the incoming light signals; a plurality of electron beam deflecting means for independently deflecting individual electron beams emitted from the electron beam generating means; and a plurality of electron beam detecting means for reproducing information from the thus-deflected electron beams to generate the outgoing light beams. The electron beam detecting means controls the electron beams so that each of the electron beams is made incident upon a desired one of said electron beam detecting means. Also, the electron beam generating means are semiconductor devices for generating electron beams.

24 Claims, 6 Drawing Sheets

ELECTRON BEAM INFORMATION EXCHANGE APPARATUS WITH CONVERTING LIGHT SIGNALS

This application is a continuation of application Ser. No. 111,597 filed 10/23/87 now abandoned.

BACKGROUND OF THE INVENTION

1. Field of the Invention

The present invention relates generally to an information exchange apparatus and, more particularly, to an electron beam exchange apparatus of the type employing a solid-state electron beam generator.

2. Related Background Art

A matrix-type switch, such as that shown in FIG. 1, employing an optical integrated circuit has conventionally been proposed as a typical example of information exchange apparatus.

FIG. 1 is a diagrammatic perspective view of such a matrix-type switch employing an optical integrated circuit.

The matrix-type switch shown in FIG. 1 includes a substrate 50 of an electro-optical crystal such as $LiNbO_3$; electrodes 51 formed on the substrate 50; optical switch portions 52; electrical terminals 53 for each allowing an electrical signal representing a command indicative of a switching operation to be transmitted therethrough to the optical switch portion 52; and channel-type optical waveguides 54, 55. In FIG. 1, reference numerals 56 and 57 denote optical fibers for guiding light signals along their respective lengths.

Light signals from the optical fibers 56 are conducted to the channel-type optical waveguides 54 by optical coupling. The transmission lines of the light signals are switched over by the optical switch portions 52 and thus these signals are output to the optical fibers 57. However, use of such an optical switch arrangement involves various problems. For example, the level of insertion loss is significantly high since the connection between each of the light waveguides 54 and the optical fibers 56 and 57 is not perfect. In addition, each optical switch element requires a size of at least about several centimeters, thus resulting in an increase in the overall size of the optical switch. Accordingly, the number of matrices that can be achieved is limited to a maximum of about $16 \times 16$.

In general, not only the above-described matrix-type switch employing such an optical integrated circuit but also conventional types of information exchange apparatus have a large size. Accordingly, there has been a demand for the development of an information exchange apparatus which can be reduced in size and be used with a multiplicity of channels.

SUMMARY OF THE INVENTION

It is therefore an object of the present invention to provide an information exchange apparatus which is compact in size and possesses adaptability for use with a multiplicity of channels due to its capability to allow electron beams to be easily deflected or modulated by the influence of an electric or magnetic field.

Further objects, features and advantages of the present invention will become apparent from the following description of preferred embodiments of the present invention taken with reference to the accompanying drawings.

DESCRIPTION OF THE PREFERRED EMBODIMENTS

Figure 1:
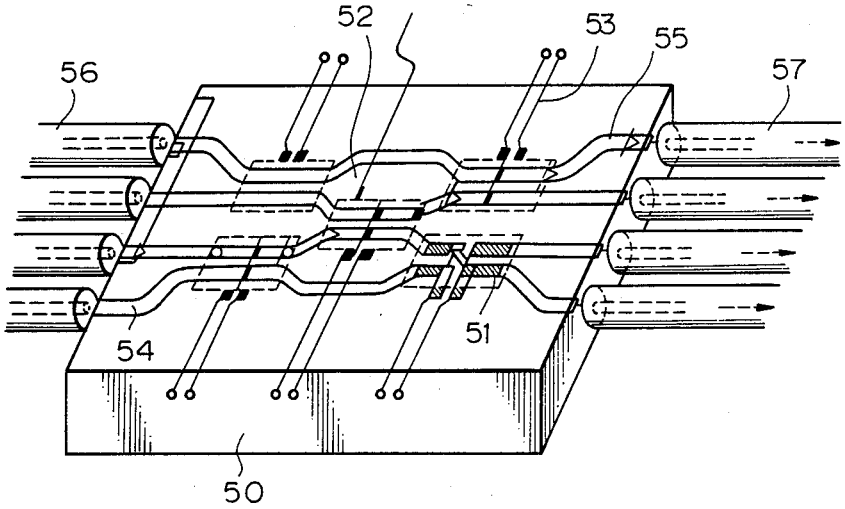
Fig. 1 PRIOR ART
FIG. 1 is a schematic perspective view of a typical conventional example of information exchange apparatus constituted by a matrix-type switch employing an optical integrated circuit.

To this end, a first preferred embodiment of the present invention which will be described later provides an electron-beam information exchange apparatus adapted to effect information exchange by connecting a plurality of incoming signal sources to a plurality of outgoing signal sources by means of electron beams. The electron-beam information exchange apparatus comprises a plurality of electron beam generating means connected to a plurality of electron beam generating means connected to a plurality of incoming signal sources; electron beam deflecting means for independently deflecting the individual electron beams emitted from the electron beam generating means; and a plurality of electron beam detecting means for reproducing information from the aforementioned electron beams.

The above-described electron beam information exchange apparatus is arranged to generate electron beams in accordance with incoming signals, control the direction of each of the electron beams by the electron beam deflecting means, and making each of the electron beams incident upon a desired one of the electron beam detecting means to cause the plurality of incoming signals to be subjected to information exchange, thereby providing a plurality of outgoing signals.

In accordance with the present invention, the miniaturization of electron beam information exchange apparatus can be achieved by employing techniques such as those disclosed in Japanese Patent examined Publication No. 30274/1984, Japanese Patent Laid-open application No. 111272/1979 (U.S. Pat. No. 4,259,678), Japanese Patent Laid-open application No. 15529/1981 (U.S. Pat. No. 4,303,930) and Japanese Patent Laid-open application No. 38528/1982, each of which provides a semiconductor device for generating electron beams comprises a cathode including a semiconductor substrate having a p-n junction which is formed between an n-type region and p-type region and which terminates at a semiconductor surface, wherein a voltage is applied in the reverse direction across the p-n junction to cause electrons to be generated by avalanche multiplication, thereby causing the electrons to emanate from the semiconductor substrate. The aforesaid miniaturization is also achieved by an electron-beam generating technique, or a similar technique, which provides a semiconductor device for generating electron beams comprises a cathode including a semiconductor substrate covered with a p-type surface region and having a p-n junction formed between an n-type region and a p-type region as well as a work function reducing material formed on the p-type surface region whereby a forward-biased voltage is applied across the p-n junction to cause electrons to emanate from a surface of the work function reducing material.

The term "information exchange" in the present invention embraces a form of processing in which a predetermined number of incoming signals are switched over to provide corresponding outgoing signals as well as a form of data processing that includes arithmetic operations such as addition and multiplication.

The above-described electron-beam information exchange apparatus provides the following advantages:

(1) The information exchange apparatus can be reduced in size, increased in its degree of integration (a multi-matrix structure), and inexpensively manufactured since a solid-state electron beam generator is employed;

(2) The step of converting incoming signals into electron beams is incorporated in the step of connecting incoming signal sources to outgoing signal sources to effect information exchange. Accordingly, the present invention is applicable to any kind of information exchange apparatus, irrespective of the types of incoming and outgoing signals that are handled by it. This is because signal switching can be performed only by providing a device for converting the incoming signals into electrical signals and a device for converting the electrical signals into outgoing signals; and (3) As stated in the above paragraph (2), the step of converting incoming signals into electron beams is incorporated in the step of connecting incoming signal sources to outgoing signal sources to effect information exchange. Accordingly, the attenuation of signal levels and increases in noise levels, both of which are occasionally involved in information exchange, can be adjusted or compensated for during the aforesaid converting step.

Preferred embodiments of an electron beam information exchange apparatus of the present invention will be described in detail below with reference to the accompanying drawings.

Figure 2:
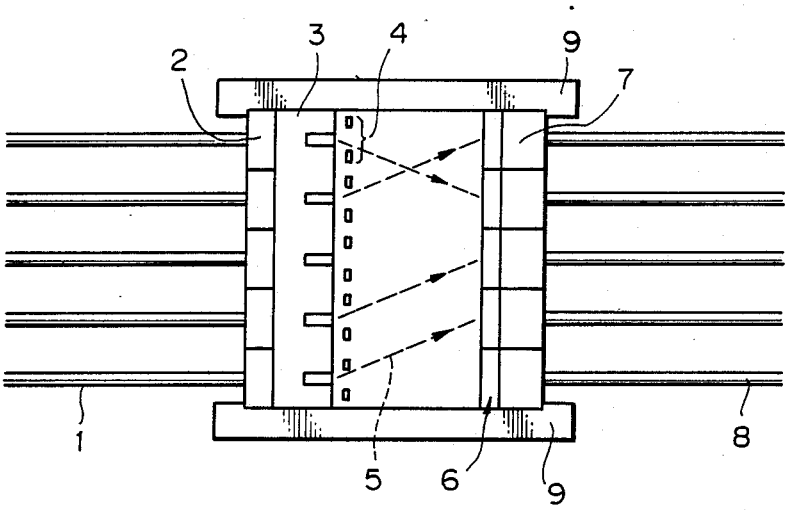
FIG. 2 is a schematic illustration of the construction of a first preferred embodiment of an electron beam information exchange apparatus of the present invention.

FIG. 2 is a diagrammatic illustration of the construction of a first preferred embodiment of an electron beam information exchange apparatus of the present invention.

The first embodiment illustrated in FIG. 2 comprises a photodetector array (PDA) 2 to which are connected optical fibers 1 for transmitting incoming signals therethrough and which converts light signals input from the optical fibers into electrical signals; electron beam sources (EBS) 3 for emitting electron beams (EB) 5; electron beam deflecting means 4 for deflecting the electron beams 5 emitted from the electron beam sources 3 (in FIG. 1, pairs of electron-beam deflecting electrodes (EBDT)); electron beam detectors (ED) 6 for detecting the electron beams 5; a laser diode array (LDA) 7 for emitting layer beams in response to the signals received by the electron beam detectors 6; and a pair of vacuum packages (VP) 9 for enclosing the transmission passage of the electron beam 5 to prevent attenuation of the electron beams 5. Optical fibers indicated collectively at 8 are connected to the laser diode array 7 to guide laser beams emitted from the array 7 along their respective lengths.

The light information signals input from the unidimensionally arranged optical fibers 1 are received by the photodetector array 2 including photodetector elements corresponding to the respective optical fibers 1. The electron beam sources 3 are driven in response to the thus-received signals. A pair of electron-beam deflecting electrodes 4 for guiding the electron beam 5 toward the electron-beam detector 6 is disposed on the emission side of each of the electron beam sources 3. The deflection angle of each electron beam 5 can be varied in accordance with an applied electrical signal (switch signal) to transmit the information from each of the optical fibers 1 to a desired one of the optical fibers 8. The electron beams 5 may be deflected either by an electric field or by a magnetic field. Accordingly, the electron beam deflecting electrodes 4 may be constituted either by spaced parallel electrodes or by coils.

In this manner, the electron beam 5 generated from each of the electron beam sources 3 is made incident upon the desired electron beam detector 6 by applying a switch signal to the corresponding electron beam deflecting electron 4. Thus, a desired laser diode of the laser diode array 7 is caused to emit a laser beam in accordance with the signal received by that electron beam deflecting electrode 4, and the resultant light signal is conducted to a corresponding one of the optical fibers 8 by optical coupling.

In the first embodiment shown in FIG. 2, by way of example, the electron beam sources 3, the electron beam deflecting electrodes 4, and the electron beam detectors 6 respectively have a unidimensional arrangement, but this arrangement is not limited solely to one dimension. For instance, such components may be two-dimensionally arranged to increase the degree of integration in the information exchange apparatus.

A second preferred embodiment of the present invention will be described below with reference to FIG. 3 in which like reference numerals are used to denote like or corresponding elements relative to those in the above-described first embodiment.

In the first embodiment, the electron beam detectors 6 are disposed independently of the laser diode array 7 for emitting laser beam in accordance with the signals detected by the electron beam detectors 6. In the second embodiment which will be described in detail below, each laser unit is used to achieve these two functions.

Figure 3:
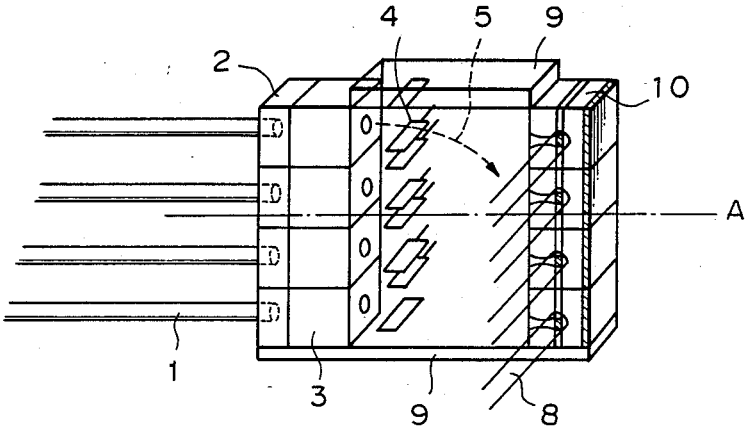
FIG. 3 is a schematic illustration of a second preferred embodiment of the present invention.

As shown in FIG. 3, each electron beam 5 is made to strike a desired stripe-shaped electrode for driving a semiconductor laser 10 to cause the semiconductor laser 10 to oscillate. The thus-generated laser beam is conducted to the optical fiber 8 by optical coupling.

Figure 4:
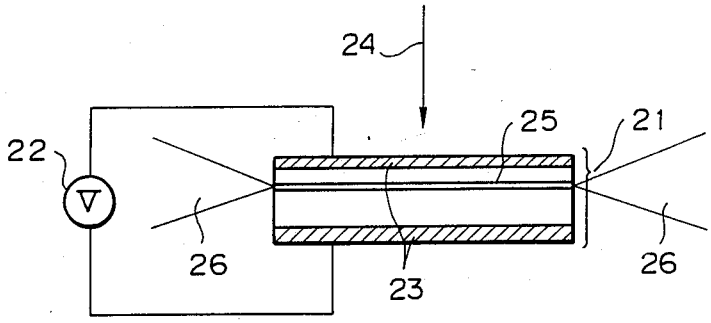
FIG. 4 is a schematic illustration of the construction of semiconductor laser incorporated in the second preferred embodiment shown in FIG. 3.

FIG. 4 is a schematic view illustrating the principle of the drive of the semiconductor laser 10, in which an arrow 24 represents the aforementioned electron beam 5.

In FIG. 4, a semiconductor laser drive circuit 22 is connected to electrodes 23 of the semiconductor laser 10, and an electrical current slightly lower than a laser oscillation threshold current is supplied to the semiconductor layer 10 from the drive circuit 22. In this state, when the electron beam 24 is made incident upon the upper one of the electrodes 23 (as viewed in FIG. 4), the amperage of the electrical current flowing in an active layer 25 is made to exceed the laser oscillation threshold current by the incident electron beam 24. Thus the semiconductor laser 10 is oscillated to generate laser beam 26. An advantage of the second embodiment resides in a reduction in the size of the information exchange apparatus.

The second embodiment based on the above-described operation principle, however, involves a shortcoming which may manifest during the drive of the electron beam information exchange apparatus. This shortcoming is described below with specific reference to FIG. 5.

The short coming mentioned above resides in the fact that each of the electron beam 5 may not be incident upon a selected one of the electron beam detectors 6 since two given ones of the electron beam sources 3 and two given ones of the electron beam detectors 6 are located in the same plane.

Figure 5:
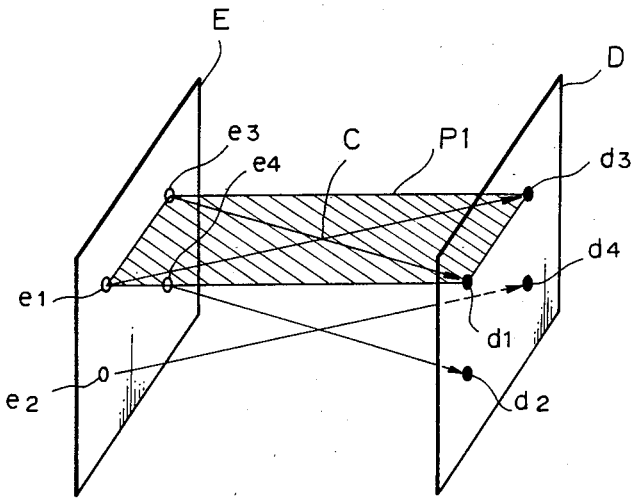
FIG. 5 is a schematic view illustrating a shortcoming derived from the collision between electron beams.

In FIG. 5, symbol E represents a plane in which a plurality of electron beam sources are located; e1 to e4 the electron beam sources; D a plane in which a plurality of electron beam detectors are located; and d1 to d4 the electron beam detectors.

Two given different electron beam sources ei, ej ($1 \leqq i, j \leqq 4, i \neq j$) are selected from among the electron beam sources located in the plane E while a given electron beam detector dk ($1 \leqq k \leqq 4$) is selected from among the electron beam sources located in the plane D. The plane defined by the three points ei, ej and dk is represented by a plane (i, j, k). In addition, given electron beam sources ei', ej' ($1 \leqq i', j' \leqq 4, i' \neq j'$) are selected from the plane E while given electron beam detectors dk' ($1 \leqq k' \leqq 4$) are selected from the plane D. The plane defined by the points ei', ej', dk' is represented by a plane (i', j', k'). In this case, points which establish ei=ei', ej=ej', dk=dk' are excluded.

In FIG. 5, the electron beam sources e1 to e4 in the plane E are located parallel to the electron beam detectors d1 to d4 in the plane D. Therefore, in this arrangement, there may be an instance where the plane (i, j, k) becomes flush with the plane (i', j', k'). For instance, a plane (1, 3, 1) defined by points e1, e3, d1 may be located in the same plane P1. In this instance, if the electron beam emitted from the electron beam source e1 is to be made incident upon the detector d3 and at the same time the electron beam emitted from the electron beam source e3 is to be made incident upon the detector d1, the electron beams from e1 and e3 collide with each other at a point C in FIG. 5. At this time, these electron beams may be caused to bend by a Coulomb interaction and thus the electron beam emitted from e1 and the electron beam emitted from e3 may not properly be incident upon the detectors d3 and d1, respectively. This could result in a problem such as a reduction in the S/N ratio of the information exchange apparatus.

The following is a description of a third preferred embodiment of the electron beam information exchange apparatus of the present invention capable of overcoming the above-described shortcoming involved in the second embodiment. The description is made with reference to FIG. 6.

Figure 6:
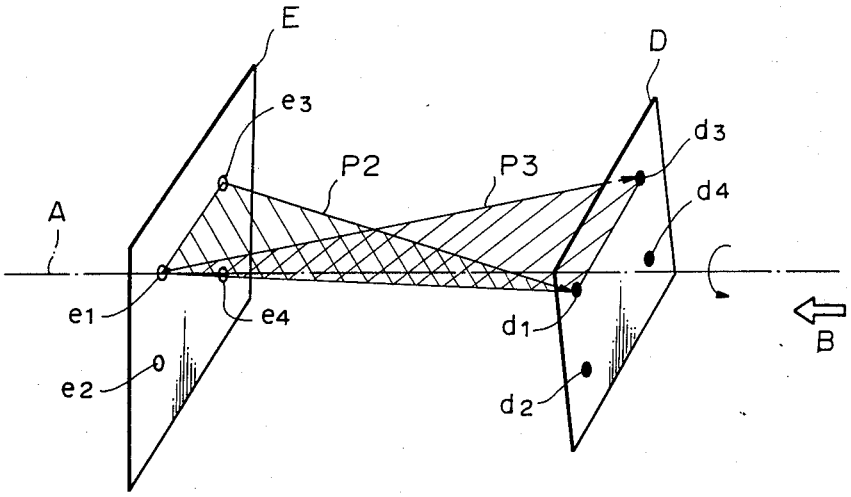
FIG. 6 is a schematic view illustrating a third embodiment which is designed to overcome the shortcoming shown in FIG. 5.
Figure 7:
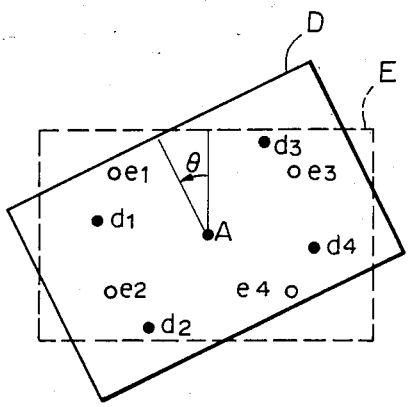
FIG. 7 is a schematic view illustrating a third embodiment which is designed to overcome the shortcoming shown in FIG. 5.

FIG. 6 schematically illustrates the third embodiment comprising an improvement in the electron beam information exchange apparatus shown in FIG. 5, in which the plane D including the electron beam detectors are rotated about the rotation axis A through an angle of $\theta$ with respect to the plane E including the electron beam sources. FIG. 7 is a view taken in the direction indicated by an arrow B of FIG. 6.

As can be seen in FIGS. 6 and 7, the plane (1, 3, 1) defined by the points e1, e3 and d1 and the plane (1, 1, 3) defined by the points e1, d1 and d3 are not located in the same plane and therefore the electron beams from the points e1 and e3 do not collide with each other. This also applies to other planes, that is, two given electron beam sources present in the plane D and two given electron beam detectors present in the plane E are not located in the same plane.

In this case, it is preferable to rotate the plane D with respect to the plane E so that at least two given points of the points e1 to en in the plane E and two given points of the points d1 to dn in the plane D are not located in the same plane (n represents the number determined by the number of signal channels that can be handled by the information exchange apparatus).

As described above, the third preferred embodiment includes electron beam generating means and electron beam detecting means, both of which are located such that two given electron beam sources of the former generating means and two given electron beam detectors of the latter detecting means are prevented from being located in the same plane. Accordingly, the electron beams emitted from the respective electron beam sources do not collide with one another and thus an information exchange apparatus having a high S/N ratio can be achieved.

Figure 8:
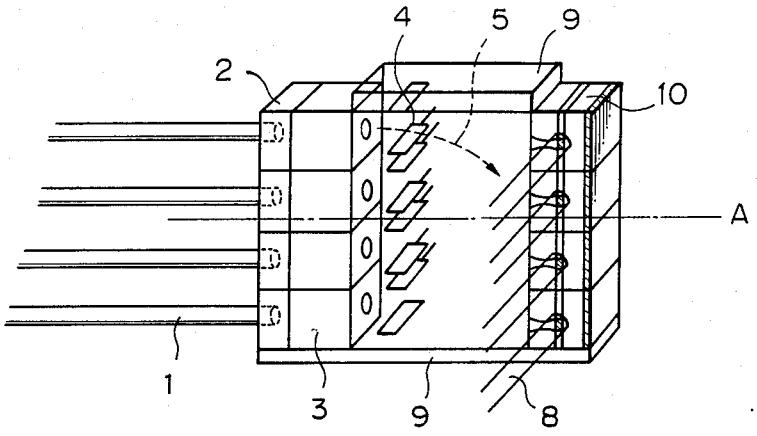
FIG. 8 is a schematic illustration of a fourth preferred embodiment of the present invention.

A fourth preferred embodiment of the present invention will be described below with reference to FIG. 8 in which like reference numerals are used to denote like or corresponding elements relative to those shown in FIG. 3.

Basically, the fourth embodiment is similar to the previously described second embodiment in that the laser units employed are each capable of achieving both the function of the electron beam source detectors and that of the laser diodes emitting laser beams in response to detection signals from these detectors. The construction of the apparatus of FIG. 8 is substantially the same as that of the one of FIG. 3. In the fourth embodiment, however, the electron beam sources 3 are rotated through a predetermined angle about the axis A with respect to opposing electron beam detecting portions incorporated in the semiconductor lasers 10. Accordingly, electron beams emitted from the respective electron beam sources do not collide with one another, whereby it is possible to provide an electron beam information exchange apparatus with a further reduced size and a high S/N ratio.

Figure 9:
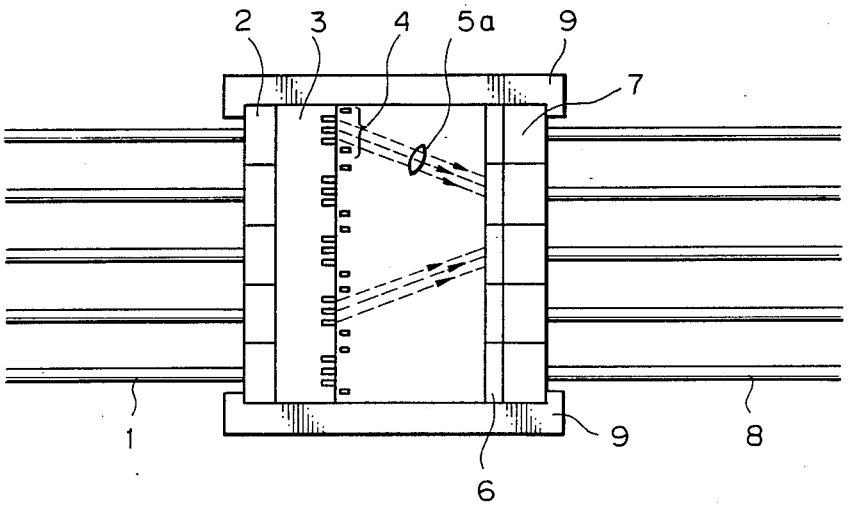
FIG. 9 is a schematic illustration of a fifth preferred embodiment of the electron beam information exchange apparatus of the present invention.

FIG. 9 is a schematic illustration of the construction of a fifth preferred embodiment of the electron beam information exchange apparatus in accordance with the present invention. In FIG. 9, like reference numerals are used to denote like or corresponding elements relative to those shown in FIG. 2.

The fifth embodiment differs from the first embodiment primarily in that a plurality of electron beam sources 3 correspond to each incoming signal so that the plurality of electron beams sources 3 are driven in response to one incoming signal. Thus each of the electron beam detectors 6 receives multiple electron beams (MEB) 5a in response to one incoming signal.

The electron beam sources 3 are fabricated by fine working techniques employing a semiconductor material which enables fabrication of emission sources having a diameter of about 0.5 microns. Therefore, a group of about one hundred electron beam sources 3 can easily be provided in correspondence with one single-mode optical fiber (core diameter: about 5 microns; clad diameter: 125 microns) which transmits an incoming signal to the electron beam information exchange apparatus. In addition, there is no significant problem in designing the wiring of a drive circuit since the aforementioned plurality of electron beam sources 3 may be driven by a common input. In this manner, at least two electron beam sources are driven in response to one incoming signal thereby enabling an increase in the amperage of electrical current with respect to one unit of information. It is therefore possible to provide a signal having a high S/N ratio.

Figure 10:
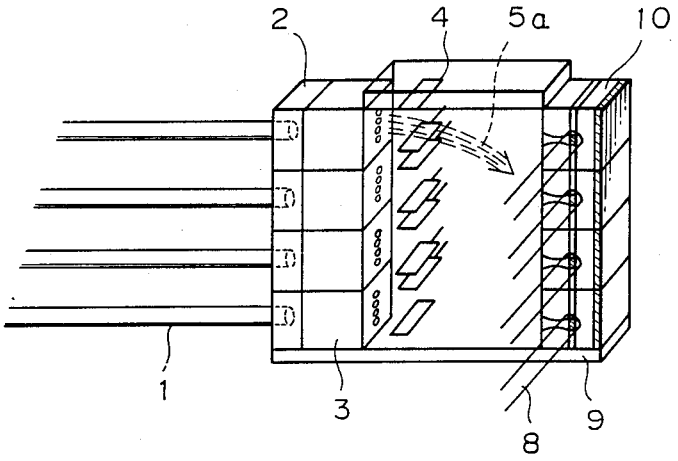
FIG. 10 is a schematic illustration of a six preferred embodiment of the present invention.

A sixth preferred embodiment of the present invention will be described with reference to FIG. 10.

In a fifth preferred embodiment, the electron beam detectors 6 are disposed independently of the laser diode array 7 for emitting laser beams ian accordance with the signals detected by the electron beam detectors 6. In the sixth embodiment which will be described in detail below, each laser unit is used to achieve these two functions as in the case of the second preferred embodiment. In FIG. 10, like reference numerals are used to denote like or corresponding elements relative to those shown in FIG. 3.

Similar to the fifth preferred embodiment, a plurality of electron beams are disposed in correspondence with one incoming signal, thereby providing a signal with a high S/N ratio.

In the above-described embodiment, the inventive apparatus is employed as a mere information exchange apparatus and, in addition, the apparatus can be operated in the following manner to perform arithmetic operations such as ORing and ANDing.

(ORing)

The amperage of an electrical current supplied from each of the electron beam sources is maintained at the same level, and a semiconductor laser drive circuit is set in such a manner that the semiconductor lasers are oscillated when the electrical current from one of the electron sources is supplied to one semiconductor laser serving as the electron beam detector. In this state, the electron beams from two of the electron beam sources may be made incident upon the electron beam detector constituted by the same semiconductor laser. This is because the semiconductor laser is oscillated by causing at least one electron beam to be incident upon the electron beam detector. This operation corresponds to the ORing of two signals.

(ANDing)

As in ORing, the amperage of an electrical current supplied from each of the electron beam sources is maintained at the same level. In ANDing, however, the semiconductor laser drive circuit is set in such a manner that the semiconductor laser is oscillated when the electrical currents from two of the electron sources are supplied to one semiconductor laser serving as the electron beam detector. In this state, the semiconductor laser is oscillated only when the electron beams from two of the electron beam sources may simultaneously be made incident upon the electron beam detector constituted by the same semiconductor laser. Accordingly, the resultant laser beam output corresponds to the ANDing of two signals.

By way of example, the above description refers to arithmetic/logical operations based on two inputs. It will be appreciated that the sixth embodiment is capable of similar operations utilizing multiple inputs. It is of course possible to easily extend the sixth embodiment for this purpose.

The third to sixth embodiments of the information exchange apparatus according to the present invention have been described with illustrative reference to an apparatus designed to switch over light signals. However, the types of incoming and outgoing signals are not confined solely to such light signals and, for instance, electrical signals or acoustic signals may also be employed. In this case, depending upon what form of signal is selected, an apparatus designed to convert incoming signals of the selected form into electrical signals for energizing the electron beam sources is disposed on an input side while an apparatus designed to convert electrical signals transmitted by electron beams into the selected form of signals is disposed on an output side. Accordingly, it is possible to easily provide an information exchange apparatus that can handle incoming and outgoing signals which differ from each other in form.

It will be appreciated from the foregoing that the present invention offers an electron beam information exchange apparatus that utilizes the easiness of deflection of electron beams and includes electron beam sources made of a semiconductor material such as Si or GaAs which is easy to work finely. Accordingly, the present invention provides advantage in that the size of the apparatus can be reduced as compared with that of prior apparatus, and in that a multi-channel device can be easily achieved.

In the present invention, the step of converting incoming signals into electron beams is incorporated in the information exchange step of effecting information exchange by connecting the incoming signal sources to the outgoing signal sources. Accordingly, the present invention possesses advantage in that it finds a variety of applications irrespective of the types of incoming and outgoing signals.

We claim:

1. An information exchange apparatus for effecting information exchange by converting incoming light signals into outgoing light signals, comprising:

a plurality of electron beam generating means for generating electron beams in accordance with said incoming light signals;

electron beam deflecting means for independently deflecting individual electron beams emitted from said electron beam generating means; and a plurality of electron beam detecting means for reproducing information from said electron beams to generate said outgoing light signals, in which said electron beam deflecting means controls said electron beams so that each of said electron beams is made incident upon a desired one of said electron beam detecting means.

2. An apparatus according to claim 1, wherein said electron beam generating means are semiconductor devices for generating electron beams.

3. An apparatus according to claim 2, wherein said semiconductor device for generating electron beams comprises a cathode including a semiconductor substrate having a p-n junction which is formed between an n-type region and a p-type region and which terminates at a semiconductor surface, wherein a voltage is applied in the reverse direction across said p-n junction to cause electrons to be generated by avalanche multiplication, thereby causing said electrons to emanate from said semiconductor substrate.

4. An apparatus according to claim 2, wherein said semiconductor device for generating electron beams comprises a cathode including a semiconductor substrate covered with a p-type surface region and having a p-n junction formed between an n-type region and a p-type region as well as a work function reducing material formed on said p-type surface region, wherein a forward-biased voltage is applied across said p-n junction to cause electrons to emanate from a surface of said work function reducing material.

5. An information exchange apparatus for effecting information exchange by converting incoming light signals into outgoing light signals, comprising:

a plurality of electron beam generating means for generating electron beams in accordance with said incoming light signals;

electron beam deflecting means for independently deflecting individual electron beams emitted from said electron beam generating means; and a plurality of electron beam detecting means for reproducing information from said electron beams to generate said outgoing light signals, in which said electron beam deflecting means controls said electron beams so that each of said electron beams is made incident upon a desired one of said electron beam detecting means, and in which said electron beam generating means and said electron beam detecting means are disposed so that two given ones of electron beam sources constituting said electron beam generating means and two given ones of electron beam detectors constituting said electron beam detecting means are not located in a same plane.

6. An apparatus according to claim 5, wherein said electron beam generating means are semiconductor devices for generating electron beams.

7. An apparatus according to claim 6, wherein said semiconductor device for generating electron beams comprises a cathode including a semiconductor substrate having a p-n junction which is formed between an n-type region and a p-type region and which terminates at a semiconductor surface, wherein a voltage is applied in the reverse direction across said p-n junction to cause electrons to be generated by avalanche multiplication, thereby causing said electrons to emanate from said semiconductor substrate.

8. An apparatus according to claim 6, wherein said semiconductor device for generating electron beams comprises a cathode including a semiconductor substrate covered with a p-type surface region and having a p-n junction formed between an n-type region and a p-type region as well as a work function reducing material formed on said p-type surface region, wherein a forward-biased voltage is applied across said p-n junction to cause electrons to emanate from a surface of said work function reducing material.

9. An apparatus according to claim 5, wherein said electron beam generating means generate electron beams in accordance with incoming light signals and said electron beam detecting means generate outgoing light signals.

10. An information exchange apparatus for effecting information exchange by coverting incoming light signals into outgoing light signals, comprising:

a plurality of electron beam generating means for generating electron beams in accordance with said incoming light signals;

electron beam deflecting means for independently deflecting individual electron beams emitted from said electron beam generating means; and a plurality of electron beam detecting means for reproducing information from said electron beams to generate said outgoing light signals, in which said electron beam deflecting means controls said electron beams so that each of said electron beams is made incident upon a desired one of said electron beam detecting means, and in which at least two given ones of said electron beam generating means generate electron beams in response to one incoming signal.

11. An apparatus according to claim 10, wherein said electron beam generating means are semiconductor devices for generating electron beams.

12. An apparatus according to claim 11, wherein said semiconductor device for generating electron beams comprises a cathode including a semiconductor substrate having a p-n junction which is formed between an n-type region and a p-type region and which terminates at a semiconductor surface, wherein a voltage is applied in the reverse direction across said p-n junction to cause electrons to be generated by avalanche multiplication, thereby causing said electrons to emanate from said semiconductor substrate.

13. An apparatus according to claim 11, wherein said semiconductor device for generating electron beams comprises a cathode including a semiconductor substrate covered with a p-type surface region and having a p-n junction formed between an n-type region and a p-type region as well as a work function decreasing material formed on said p-type surface region, wherein a forward-biased voltage is applied across said p-n junction to cause electrons to emanate from a surface of said work function reducing material.

14. An apparatus according to claim 10, wherein said electron beam generating means generate electron beams in accordance with incoming light signals and said electron beam detecting means generate outgoing light signals.

15. An information exchange apparatus for effecting information exchange by converting incoming signals into outgoing signals, comprising:

a plurality of electron beam generating means, each for generating an electron beam in accordance with said incoming signals;

electron beam deflecting means for deflecting associated ones of said plurality of electron beams emitted from said plurality of electron beam generating means; and a plurality of electron beam detecting means for reproducing information from said electron beams to generate said outgoing signals.

wherein said electron beam deflecting means control said electron beams so that each of said electron beams is made incident upon a desired one of said electron beam detecting means, and wherein said electron beam generating means and said electron beam detecting means are disposed so that two given ones of electron beam sources constituting said electron beam generating means and two given ones of electron beam detectors constituting said electron beam detecting means are not located in a common plane.

16. An apparatus according to claim 15, wherein said electron beam generating means are semiconductor devices for generating electron beams.

17. An apparatus according to claim 16, wherein said semiconductor device for generating electron beams comprises a cathode including a semiconductor substrate having a p-n junction which is formed between an n-type region and a p-type region and which terminates at a semiconductor surface, wherein a voltage is applied in the reverse direction across said p-n junction to cause electrons to be generated by avalanche multiplication, thereby causing said electrons to emanate from said semiconductor substrate.

18. An apparatus according to claim 16, wherein said semiconductor device for generating electron beams comprises a cathode including a semiconductor substrate covered with a p-type surface region and having a p-n junction formed between an n-type region and a p-type region as well as a work functions reducing material formed on said p-type surface, wherein a forward-biased voltage is applied across said p-n junction to cause electrons to emanate from a surface of said work function reducing material.

19. An apparatus according to claim 15, wherein said electron beam generating means generate electron beams in accordance with incoming light signals and said electron beam detecting means generate outgoing light signals.

20. An information exchange apparatus for effecting information exchange by converting incoming signals into outgoing signals, comprising:

a plurality of electron beam generating means, each for generating an electron beam in accordance with said incoming signals;

electron beam deflecting means for deflecting associated ones of said plurality of electron beams emitted from said plurality of electron beam generating means; and a plurality of electron beam detecting means for reproducing information from said electron beams to generate said outgoing signals, wherein said electron beam deflecting means control said electron beams so that each of said electron beams is made incident upon a desired one of said electron beam detecting means, and wherein at least two given ones of said electron beam generating means generate electron beams in response to one incoming signal.

21. An apparatus according to claim 20, wherein said electron beam generating means are semiconductor devices for generating electron beams.

22. An apparatus according to claim 21, wherein said semiconductor device for generating electron beams comprises a cathode including a semiconductor substrate having a p-n junction which is formed between an n-type region and a p-type region and which terminates at a semiconductor surface, wherein a voltage is applied in the reverse direction across said p-n junction to cause electrons to be generated by avalanche multiplication, thereby causing said electrons to emanate from said semiconductor substrate.

23. An apparatus according to claim 21, wherein said semiconductor device for generating electron beams comprises a cathode including a semiconductor substrate covered with a p-type surface region and having a p-n junction formed between an n-type region and a p-type region as well as a work function decreasing material formed on said p-type surface region, wherein a forward-biased voltage is applied across said p-n junction to cause electrons to emanate from a surface of said work function reducing material.

24. An apparatus according to claim 20, wherein said electron beam generating means generate electron beams in accordance with incoming light signals and said electron beam detecting means generate outgoing light signals.

* * * * *